US006579380B2

(12) United States Patent
Martin et al.

(10) Patent No.: US 6,579,380 B2
(45) Date of Patent: Jun. 17, 2003

(54) METHOD AND APPARATUS FOR CLEANING MOLDS USED IN THE GLASS FABRICATION INDUSTRY

(75) Inventors: Terry W. Martin, Oakville (CA); Alex Maule, Burlington (CA)

(73) Assignee: Ablation Technologies Inc., Burlington (CA)

( * ) Notice: Subject to any disclaimer, the term of this patent is extended or adjusted under 35 U.S.C. 154(b) by 93 days.

(21) Appl. No.: 09/780,463

(22) Filed: Feb. 12, 2001

(65) Prior Publication Data

US 2001/0020479 A1 Sep. 13, 2001

Related U.S. Application Data

(63) Continuation-in-part of application No. 09/188,528, filed on Nov. 10, 1998, now abandoned.
(60) Provisional application No. 60/065,288, filed on Nov. 12, 1997.

(51) Int. Cl.[7] ..... F23J 1/00
(52) U.S. Cl. ..... 134/20; 134/1; 134/17; 134/19; 134/30; 134/32; 134/37; 134/27; 134/39; 65/27; 65/168
(58) Field of Search ..... 134/19, 20, 30, 134/36, 37, 39, 1, 32, 17; 65/27, 168

(56) References Cited

U.S. PATENT DOCUMENTS 3,775,086 A * 11/1973 Muranaka ..... 65/323
4,089,702 A * 5/1978 Enoksson et al. ..... 102/302
5,082,502 A * 1/1992 Lee et al. ..... 134/1

FOREIGN PATENT DOCUMENTS

JP 4-193966 * 7/1992

* cited by examiner

*Primary Examiner*—Randy Gulakowski
*Assistant Examiner*—M. Kornakov
(74) *Attorney, Agent, or Firm*—Robert F. Delbridge

(57) ABSTRACT

A method of removing graphite from metal molds used in the glass fabrication industry, the method including placing a metal glass-fabricating mold with graphite bonded thereto in a chamber, providing an oxygen rich mixture of combustible gases in the chamber, said oxygen rich mixture containing from about 10 to about 25% stoichiometric excess of oxygen, and igniting the oxygen rich mixture of combustible gases in the chamber to produce a temperature of at least about 6,000° F. and a pressure wave. A high temperature wave front and the pressure wave thereby produced remove graphite from the metal mold by ablation of the graphite.

1 Claim, 4 Drawing Sheets

METHOD AND APPARATUS FOR CLEANING MOLDS USED IN THE GLASS FABRICATION INDUSTRY

This application is a continuation-in-part of U.S. patent application Ser. No. 09/188,528 filed Nov. 10, 1998, now abandoned, which claims priority from U.S. Provisional Patent Application No. 60/065,288 filed Nov. 12, 1997.

FIELD OF INVENTION

This invention relates to cleaning molds used in the glass fabrication industry in a cost effective and environmentally safe manner.

BACKGROUND OF INVENTION

The glass industry utilizes glass molding equipment for the fabrication of glass containers and other articles. In the molding process, substantially pure primary graphite powder mixed with various proprietary chemical compounds is applied to the molds in order to facilitate mold separation and glass flow. The various proprietary chemical compounds function to disperse and bond the graphite to the molds. Because glass temperature during molding reaches about 2,000° F., the chemical compounds react to cause a layer of substantially pure primary graphite to become chemically bonded to the molds. After successive applications of the graphite powder/chemical compound mixture as required by the glass process, a closely laminated layer of graphite containing trace amounts of proprietary bonding agent is built up on the mold. This graphite layer must then be cleaned from the mold when its thickness adversely affects the dimensional requirements of the glass container being produced. The characteristics of the bonded layer are that of graphite, in particular with a melting point of about 5,800° F. and a boiling point of about 6,700° F.

Due to the lubricating nature of the graphite, its removal has in the past been effected by abrasion using relatively high energy particles in a so-called blasting operation. This is effective but results in damage to the mold due to the inability to limit the particle trajectory solely within the boundary of the graphite layer. The result is damage to the mold which limits the mold life. The blasting operation can be moderated to minimize damage to the mold, but a proportionately longer time is then required to totally remove the graphite layer.

It is therefore an object of the present invention to provide an improved method for removing a graphite layer from a glass mold, and to provide apparatus for carrying out the method.

SUMMARY OF THE INVENTION

According to the present invention, a method of removing graphite from metal molds used in the glass fabrication industry includes placing a metal glass-fabricating mold with graphite bonded thereto in a chamber, providing an oxygen rich mixture of combustible gases in the chamber, with the oxygen rich mixture containing from about 10 to about 25% stoichiometric excess of oxygen, and igniting the oxygen rich mixture of combustible gases in the chamber to produce a temperature of at least about 6,000° F. and a pressure wave. A high temperature wave front and the pressure wave thereby produced remove graphite from the metal mold by ablation of the graphite.

The invention also provides apparatus for removing graphite from metal molds used in the glass fabrication industry, the apparatus including a housing having a mold-receiving chamber, a gas supply for supplying an oxygen rich mixture of combustible gases to the mold, receiving chamber, with the oxygen rich mixture containing from about 10 to about 25% stoichiometric excess of oxygen, and an igniter for igniting the oxygen rich mixture combustible gases in the chamber to produce a temperature of at least about 6,000° F. and a pressure wave. A high temperature wave front and the pressure wave thereby produced, remove graphite from a metal mold in the chamber by ablation of the graphite. An exhaust valve is subsequently operable to remove products of combustion from the chamber.

The apparatus also includes a mold feeder carriage moving horizontally between an open position outside the chamber and an operative position inside the chamber, a chamber closure member moving with the carriage to close an open end of the chamber when the carriage is in the operative position, and a pair of wedge members movable between retracted and operative positions and which, in the operable positions, engage the closure member to retain it in the chamber-closing position.

The ablation step is believed to comprise melting and partial oxidation of the graphite and subsequent removal of brittle oxidic material so formed.

DESCRIPTION OF THE DRAWINGS

One embodiment of the invention will now be described, by way of example, with reference to the accompanying drawings, of which.

DESCRIPTION OF PREFERRED EMBODIMENT

Figure 1:
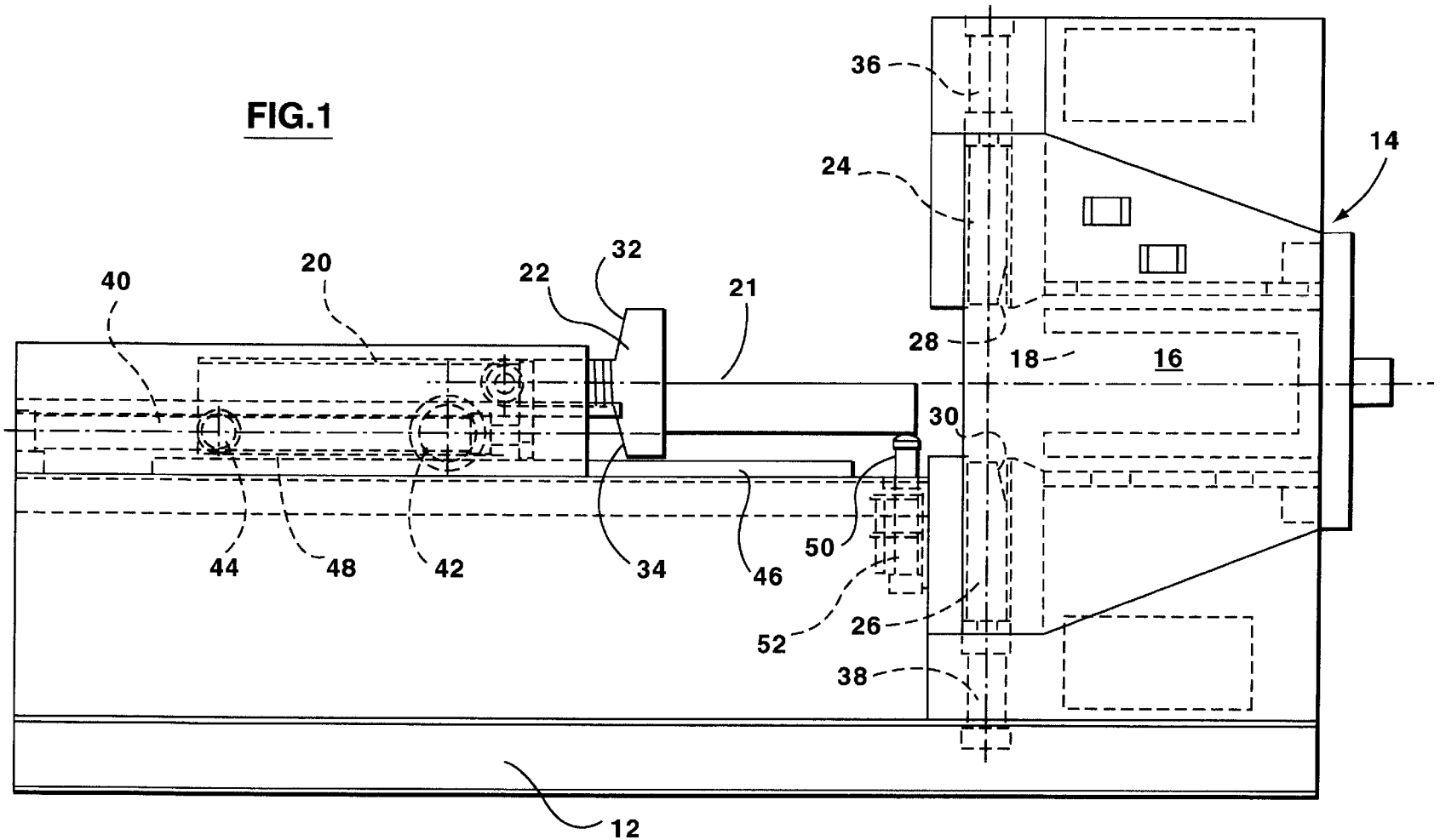
FIG. 1 is a diagrammatic side view of mold cleaning apparatus, with the feeder carriage and the wedge cams at their fully retracted open positions away from the cleaning chamber.
Figure 2:
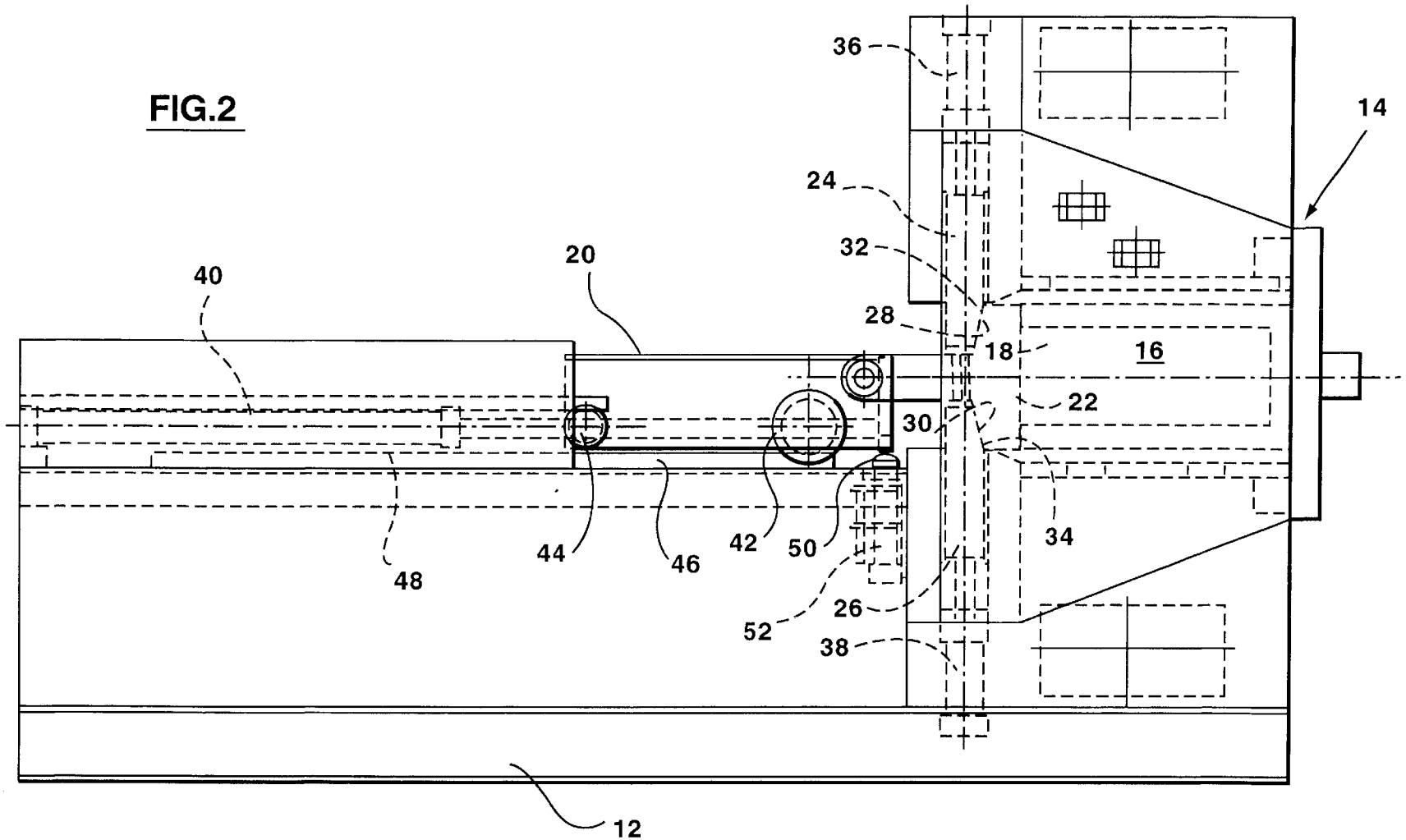
FIG. 2 is a similar view to FIG. 1 showing the feeder carriage and the wedge cams at their operative positions.

Referring to the accompanying drawings, FIGS. 1 and 2 show mold cleaning apparatus having a base 12 which carried a housing 14 with a mold cleaning chamber 16 which is open at one end 18 and also carried a feeder carriage 20 (seen in its retracted position in FIG. 1) which is slidably mounted thereon for movement towards and away from the mold cleaning chamber 16. The feeder carriage 20 has a mold carrying basket member 21 projecting forwardly therefrom and a chamber closing member 22 at the rear end thereof. When the feeder carriage 20 is in its operative position, the closure member 22 closes the open end 18 of the chamber 16 as shown in FIG. 2. For clarity, the basket member 21 has not been shown in FIG. 2.

The chamber housing 14 carries upper and lower vertically moveable wedge members 24, 26, shown in their retracted positions in FIG. 1. When the feeder carriage 20 is in its operative position (shown in FIG. 2) the upper wedge member 24 is moved vertically downwardly and the lower wedge member 26 is moved vertically upwardly to engage the rear of the closure member 22. The upper and lower wedge members 24, 26 have angled faces 28, 30 respectively which engage complementarily inclined faces 32, 34 respectively on the rear of the closure member 22 to force the closure member 22 into firm closing engagement with the open end 18 of the chamber 16 and retain the closure member 22 in such firm closing engagement.

Movement of the upper and lower wedge members 24, 26 is effected by hydraulic cylinders 36, 38, and movement of the feeder carriage 20 is effected by means of a hydraulic cylinder 40. The feeder carriage 20 has forward and rear wheels 42, 44 which run on tracks 46, 48 respectively. When the feeder carriage 20 is in the fully retracted position, as shown in FIG. 1, a vertically movable support bearing 50 supports the bolt carrying basket member 21. When the feeder carriage 20 advances to the operative position, the support bearing 50 is retracted as shown in FIG. 2 to permit the closing member 22 to pass. Movement of the support bearing 50 is effected by a hydraulic cylinder 52.

Figure 3:
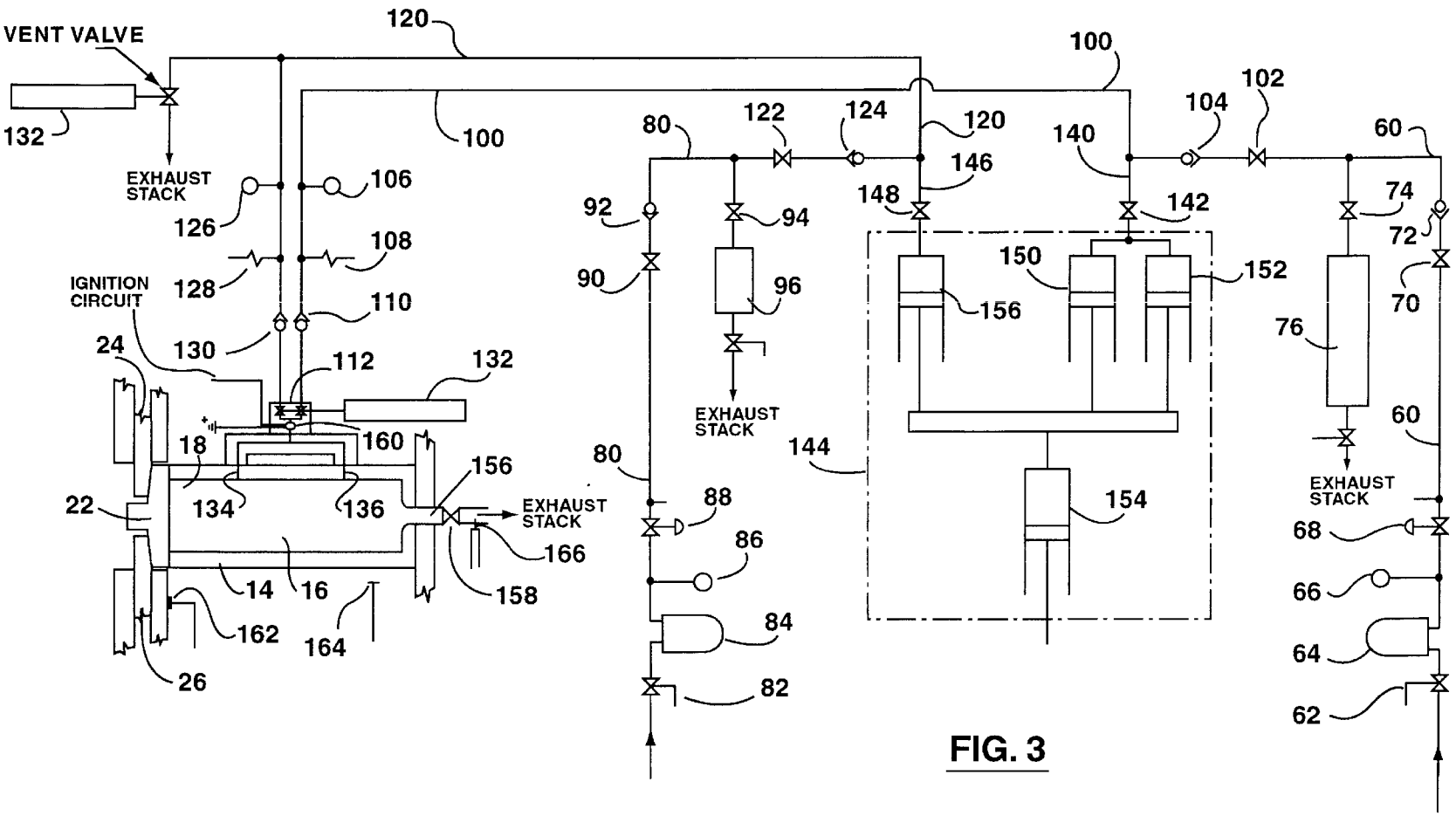
FIG. 3 is a schematic view showing the fuel system for supplying gaseous fuel to the cleaning and FIG. 4 is a perspective view of a glass half mold used as a test.

FIG. 3 shows the fuel system for feeding the required mixture of oxygen and required gas to the mold cleaning chamber 16. Oxygen from a 150 psi supply is fed along line 60 through a manually-operable ball valve 62, a filter 64, a pressure gauge 66, a pressure regulator 68, a solenoid valve 70, a check valve 72 and a solenoid valve 74 to an intermediate tank 76. Similarly, natural gas from a 150 psi supply is fed along line 80 through a manually-operable valve 72, a filter 84, a pressure gauge 86, a pressure regulator 88, a solenoid valve 90, a check valve 92 and a solenoid valve 84 to an intermediate tank 96.

Beyond check valve 72, oxygen fuel line 60 is also connected to a fuel line 100 and feeds oxygen through a solenoid valve 102, check valve 104, pressure gauge 106, pressure transducer to 108 and check valve 110 to a gas, ignition and vent valve 112. Similarly, beyond check valve 92, natural gas line 80 is also connected to a fuel line 120 which feeds natural gas through a solenoid valve 122, check valve 124, pressure gauge 126, pressure transducer 128 and check valve 130 to the valve 112. The valve 112 is opened and closed by a hydraulic cylinder 132 and, when opened, feeds an oxygen-natural gas fuel mixture along passages 134, 136 into the cleaning chamber 16 at longitudinally spaced positions therein.

Oxygen line 100 is also connected by line 140 and solenoid valve 142 to a hydraulically-operated gas charge cylinder system 144. Similarly, natural gas line 120 is also connected by line 146 and solenoid valve 148 to the gas charge cylinder system 144. In the gas charge cylinder system 144, oxygen is supplied through line 140 and solenoid valve 142 to two charge cylinders 150, 152, and natural gas is supplied through line 144 and solenoid valve 148 to a charge cylinder 156. The volume of charge cylinders 150, 152 and 156 is controlled by a hydraulic cylinder 154.

In use, intermediate tanks 76, 96 are filled with oxygen and natural gas respectively at 150 psi with solenoid valves 102, 122 shut and solenoid valves 70, 74 and 90, 94 open. With the valve 112 closed and the cleaning chamber 16 closed as shown in FIG. 2, with molds to be cleaned (not shown) in the basket member 21 therein, solenoid valves 74, 94 are closed and solenoid valves 70, 102, 142 and 90, 122, 148 opened so that natural gas flows from line 60 through solenoid valve 102, check valve 104 and solenoid valve 142 into charge cylinders 150, 152, with hydraulic cylinder 154 being contracted to cause charge cylinders 150, 152 to be filled to maximum capacity. Similarly, oxygen flows from line 80 through solenoid valve 122, check valve 124 and solenoid valve 148 into charge cylinder 156. The charging cylinders 150, 152 and 156 and lines 100, 120 to valve 112 reach a steady 150 psi pressure, which is measured by the pressure transducers 108, 128.

When the cleaning chamber 16 is to be charged with a gaseous fuel mixture, the solenoid valves 74, 102 and 94, 122 and valve 112 are opened, with solenoid valve 70, 142 and 90, 148 closed, to cause gas at 150 psi in the intermediate tanks 76, 96 to flow through lines 100, 120 and through the valve 112 into the cleaning chamber 16 to pressurize the chamber 16 to approximately 75 psi, which is measured by pressure transducers 108, 128. When this pressure has stabilized, solenoid valves 102, 122 are closed and solenoid valves 142, 148 are opened, and charged cylinders 150, 152 and 156 are contracted by means of hydraulic cylinder 154 to pressurize lines 100, 120 and chamber 16 to 150 psi, again measured by the pressure transducers 108, 128. The valve 112 is then closed, so that the charge of oxygen and natural gas is sealed in the chamber 16 and is ready for ignition.

At this time, solenoid valve 70, 74 and 90, 94 are opened (with solenoid valves 102, 122 being closed) to cause the intermediate tanks 76, 96 to again be pressurized to 150 psi.

The gaseous mixture in the cleaning chamber 16 is then ignited by an igniter in the form of a spark plug 160 located immediately downstream of the mixing valve 112. Ignition then travels along passages 134, 136 into the cleaning chamber 16 at longitudinally spaced positions therein. The resultant explosion causes the molds on the basket member 21 to be cleaned in the manner previously described. The cleaning chamber 16 is then exhausted through an exhaust line 156 provided at the rear end of chamber 16 and controlled by a hydraulically actuated valve 158. The explosion is suitably monitored, for example by a vibration sensor 162 adjacent the wedge member 26, an acoustic sensor 164 adjacent the housing 14, and a thermocouple 166 in the exhaust line 156 downstream of the valve 158.

It will be readily apparent to a person skilled in the art that the above described embodiment of the invention can be fully automated.

Specific examples of the invention will now be described.

EXAMPLE 1

Figure 4:
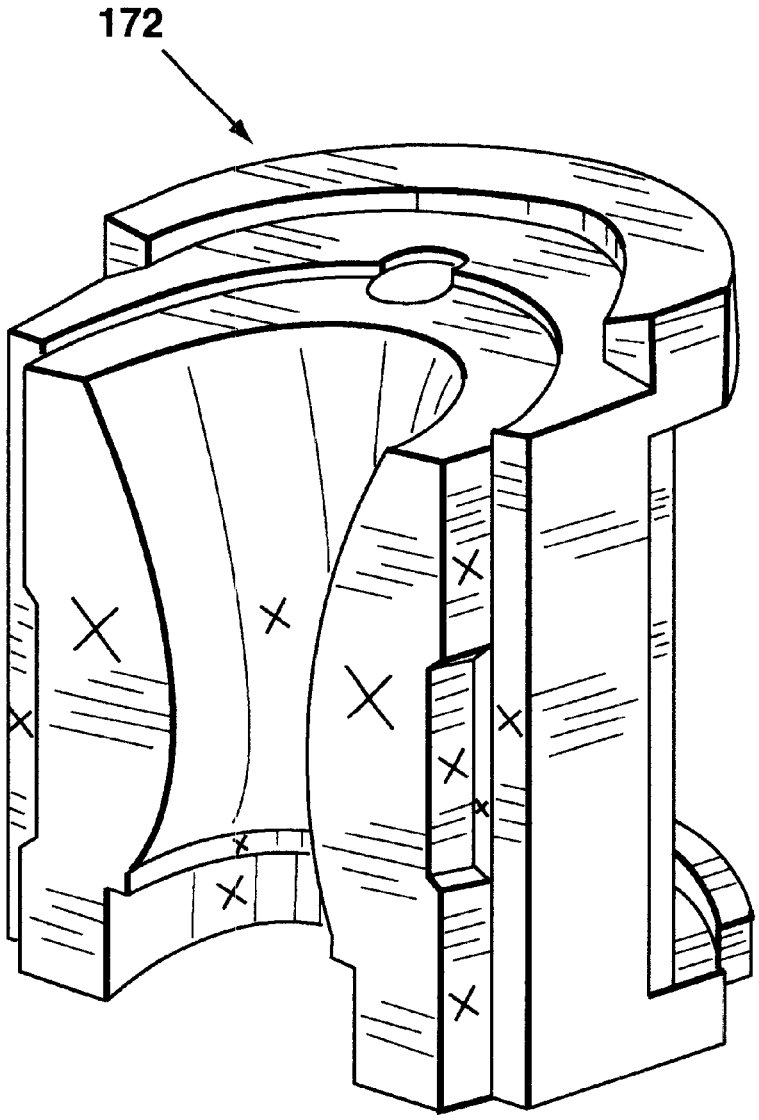

A glass half mold 172 made of cast iron and with dimensions of 6×8×3 inches as shown in FIG. 4 was utilized for this test. The half mold was used in production and had been removed for cleaning. Observation of the mold showed that graphite had become bonded thereto on external surfaces indicated by X in FIG. 4. The graphite thickness varied from place to place, from a minimum of about 0.002 to more than about 0.012 inches, following the contour of the mold. The mold was allowed to cool to a temperature of about 24° C. and was then placed inside a pressure vessel with dimensions of 10×6 inches. The pressure vessel was sealed and filled with oxygen and natural gas. Both gases were injected from a 150 psi source using pressure regulator valves. The gases were allowed to freely fill the container and reach a dynamic equilibrium on their own accord. Once filled, the charging valves were closed. The mixture was then ignited using a high voltage discharge in the pressure vessel. A sharp impact noise was heard and the vessel became hot to the touch. The measured temperature was about 60° C.

The pressure vessel was then opened and examined. The mold was observed not to have moved appreciably. The mold was also noticeably warm, so much so as to be too hot to be held by bare hands. The measured temperature was 65° C. After observation, the mold was removed by hand with the assistance of leather faced gloves. Once removed, detailed observation of the mold showed that the majority of the graphite had been removed, but that a small amount still remained. The mold was again placed in the pressure vessel and the method repeated. The result after the repeated method was complete cleaning of the mold, with the exception of a small amount of powder residue which could be easily wiped from the surface of the mold using a cloth.

EXAMPLE 2

A glass half mold made of brass alloy and with the same dimensions as before was utilized for this test. Again, the mold had been used in production and had been removed for cleaning. Observation showed that graphite had become bonded thereto on the external surfaces as in the previous example. The thickness of the graphite varied from place to place from a minimum of about 0.001 to over about 0.004 inches, following the contour of the mold. The mold was cleaned in a similar manner to that described in Example 1, with similar results. After removal from the pressure vessel, detailed observation of the mold showed that it was completed devoid of the graphite, again with the exception of a small amount of powder residue which could easily be wiped from the mold surface using a cloth.

EXAMPLE 3

Three small ring-shaped proportions of a glass mold made of a steel alloy and with dimensions of approximately 4×3 inches were utilized for this test. The ring-shaped portions had been used in production and had been removed for cleaning. Observation showed that graphite had become bonded thereto on various external areas, with the thickness varying from a minimum of about 0 to about 0.002 inches. The ring-shaped portions were treated as in the previous examples, with similar results. After removal from the pressure vessel, detailed observation showed that the surfaces of the ring-shaped portions which were exposed to the detonation were completely devoid of graphite. Surfaces which were shielded from direct exposure, such as the surface which the ring-shaped portions were resting on, had little if any of the deposit removed.

EXAMPLE 4

This test was a continuation of Example 3 using two small ring shaped portions which had deposits of graphite bonded thereto varying from a minimum of zero to about 0.003 inches. In this example, a tree-shaped frame was used to support the ring-shaped portions in the pressure vessel such that there was minimal shielded surface area of the ring-shaped portions. The same procedure was followed as before. After removal from the pressure vessel, detailed observation of the ring-shaped portions showed that their surfaces were devoid of graphite, with the exception of a dust-like material. This residue was removed using a blast of compressed air.

Other embodiments and examples of the invention will be readily apparent to a person skilled in the art, the scope of the invention being defined in the appended claims.

What is claimed is:

1. A method of removing graphite from metal molds used in the glass fabrication industry, the method including:

providing apparatus including a housing having a mold-receiving chamber;

a gas supply for supplying an oxygen rich mixture of combustible gases to the mold-receiving chamber, said oxygen rich mixture containing from at least 10 to about 25% stoichiometric excess of oxygen;

an igniter for igniting the oxygen rich mixture of combustible gases in the chamber to produce a temperature of at least about 6,000° F. and a pressure wave, whereby a high temperature wave front and the pressure wave remove graphite from a metal mold in the chamber by ablation of the graphite;

an exhaust valve subsequently operable to remove products of combustion from the chamber, a mold feeder carriage movable horizontally between an open position outside the chamber and an operable position inside the chamber; and a chamber closure member moving with the carriage to close an open end of the chamber when the carriage is in the operative position:

the method also including:

placing a metal glass-fabricating mold with graphite bonded thereto on the mold feeder carriage when in the open position;

moving the carriage to the operable position;

causing the gas supply to supply said oxygen rich mixture to the chamber;

igniting the oxygen rich mixture to produce a temperature of at least about 6,000° F. and a pressure wave;

whereby a high temperature wave front and the pressure wave thereby produced remove graphite from the metal mold by ablation of the graphite;

returning the carriage to the open position; and removing the mold therefrom.

* * * * *